US005686008A

United States Patent [19]

Brückner et al.

[11] Patent Number: 5,686,008

[45] Date of Patent: Nov. 11, 1997

[54] CLOSURE AND REGULATION APPARATUS FOR A METALLURGICAL VESSEL

[75] Inventors: Raimund Brückner, Engenhahn-Niedernhausen; José Gimpera, Wiesbaden, both of Germany; Steve Lee, Clydebank, Scotland

[73] Assignee: Didier-Werke AG, Wiesbaden, Germany

[21] Appl. No.: 682,770

[22] PCT Filed: Nov. 25, 1995

[86] PCT No.: PCT/EP95/04650

§ 371 Date: Sep. 24, 1996

§ 102(e) Date: Sep. 24, 1996

[87] PCT Pub. No.: WO96/16757

PCT Pub. Date: Jun. 6, 1996

[30] Foreign Application Priority Data

Nov. 29, 1994 [DE] Germany ..... 44 42 336.5

[51] Int. Cl.[6] ..... B22D 41/14

[52] U.S. Cl. ..... 222/598; 266/236; 222/603

[58] Field of Search ..... 222/597, 598, 222/599, 591, 603; 266/236, 239

[56] References Cited

U.S. PATENT DOCUMENTS

| | | | |
|---|---|---|---|
| 5,025,961 | 6/1991 | Hintzen et al. | 222/598 |
| 5,058,784 | 10/1991 | Hintzen et al. | 222/598 |
| 5,160,060 | 11/1992 | Hintzen et al. | 222/603 |
| 5,230,813 | 7/1993 | Hintzen | 222/599 |

*Primary Examiner*—Scott Kastler

*Attorney, Agent, or Firm*—Wenderoth, Lind & Ponack

[57] ABSTRACT

A closure and/or regulation apparatus for controlling the outflow of melt from a metallurgical vessel includes a stator and a rotor rotatable relative to the stator. Additional responsive control of outflow is provided by a chamber that is part of or is connected to an outflow channel that can be connected to a vacuum generator.

19 Claims, 6 Drawing Sheets

17
16
28
4
14
2
1
8
9
5'
6'
27
3
10
26
L
11

CLOSURE AND REGULATION APPARATUS FOR A METALLURGICAL VESSEL

BACKGROUND OF THE INVENTION

The invention relates to a closure and/or regulation apparatus for controlling the outflow from a metallurgical vessel, in particular for the close to final dimension casting of steel, and including a stator and a rotor rotatable relative thereto. The stator and rotor are provided with cooperating sealing surfaces and have through-passages or openings which terminate in the region of the sealing surfaces in an outflow channel, and which can be brought into and out of alignment by rotating the rotor.

DE 39 34 601 C1 discloses such a closure and/or regulation apparatus. Through a gas channel provided in the stator or in the rotor, insert gas can be supplied to a gas distribution chamber. This is said to decrease the wear of the sealing surfaces and through-passages or openings.

DE 38 10 302 C2 discloses a casting apparatus for the continuous manufacture of metal banding. A controlled gas pressure acts on the surface of a melt in a casting chamber in order to regular the height of the melt level. Such regulation is inert because it must act upon the entire volume of the melt. At the casting nozzle itself no further regulation capability is provided.

DE 38 05 071 C2 discloses a closure and/or regulation apparatus in which a rotor is rotatably supported in a stator transversely to the direction of flow of the melt. This design is especially suitable for continuous casting of banding or for thin slab casting.

In German Patent Application P 43 19 966, an immersion outlet is employed as a closure and/or regulation apparatus with a stator and a rotor. In an outflow channel is provided a sump chamber which broadens and makes uniform the melt flow for thin slab casting or band casting.

SUMMARY OF THE INVENTION

The invention provides a closure and/or regulation apparatus of the above type which, in addition to the mechanical capability of influencing the melt flow, also provides a further capability in order to be able to regulate responsively the melt flow near the outflow thereof.

According to the invention, the above achieved in an underpressure chamber is provided in the stator and/or the rotor. The underpressure chamber can be connected via a channel or conduit disposed in the stator and/or in the rotor with a vacuum generating unit, and is disposed above the through-passages or openings and is connected with the outflow channel.

Thereby, directly in the closure and/or regulation apparatus an underpressure is made effective. By controlling the underpressure, the rate at which the melt flows through the outflow channel is rapidly and responsively adapted to particular conditions, for example the bath level in the metallurgical vessel or the state of wear of the through-passages or openings. The underpressure counteracts the ferrostatic pressure of the melt in the vessel. By rotating the rotor, the melt flow additionally can be controlled.

BRIEF DESCRIPTION OF THE DRAWINGS

Further features and advantages of the invention are evident from the following description of exemplary embodiments, with reference to the drawings, wherein.

DETAILED DESCRIPTION OF THE INVENTION

Corresponding parts are provided with identical reference symbols in the various figures.

At the bottom of a metallurgical vessel is disposed a closure and/or regulation element for controlling the outflow of a melt 2.

Figure 1:
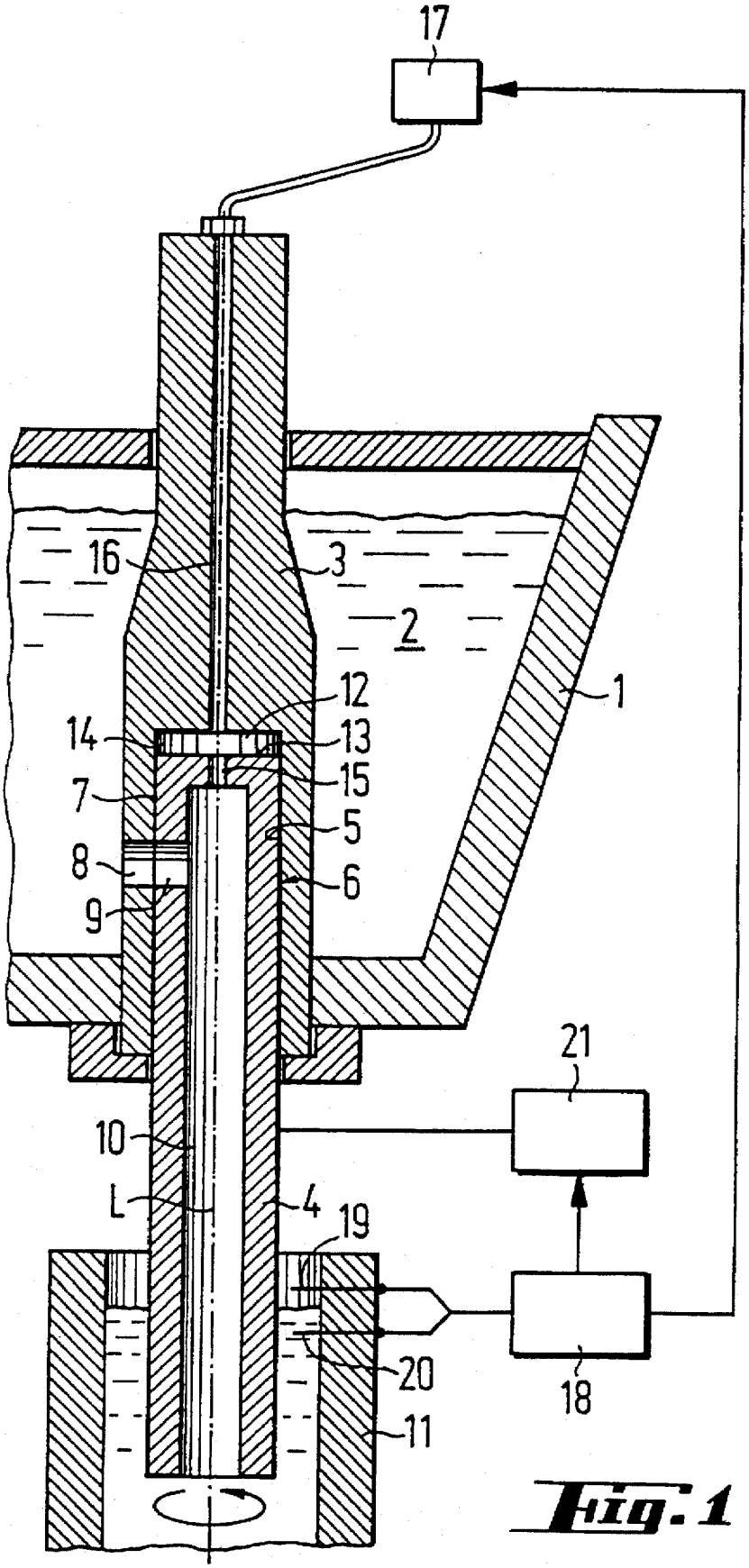
FIG. 1 is a cross section of a closure and/or regulation element wherein a rotor engages a stator from below.

In the embodiment according to FIG. 1, a rotor 4 is rotatable supported in a stator 3. The stator 3 and the rotor 4 are in contact with one another at respective cylindrical sealing surfaces 5, 6, between which is formed a sealing gap 7. The stator 3 and the rotor 4 have therethrough respective through-passages or openings 8, 9. By rotating the rotor 4, the openings 8, 9 can be made to more or less coincide, such that outflow of melt 2 from vessel 1 can be controlled by rotation of the rotor 4. The through-passage or opening 9 of the rotor 4 extends into a vertical overflow channel 10 which is provided in the rotor 4. A lower end of rotor 4 extends into a chill mold 11.

A front or inner axial end face 12 of stator 3 is opposed by a front or axial end face 13 of rotor 4. Between the faces 12, 13 is a space which, as will be described later in further detail, forms an underpressure chamber 14. The underpressure chamber 14 is open toward and in communication with the sealing gap 7. In addition, chamber 14 is connected with the outflow channel 10 via at least one bore 15. In the stator 3 is a channel conduit 16, which, on the one hand, terminates or opens onto the front face 12 in the underpressure chamber 14 and, on the other hand, extends to outside of the vessel 1 is connected with a vacuum generator 17.

The vacuum generator 17 is controllable by a control device 18. The control device 18 senses, via an upper sensor 19 and a lower sensor 20, the level of the melt in the chill mold 11. Other means for sensing the level of the melt in the chill mold 11 can also be provided. To the control device 18 additionally can be connected a drive unit 21 with which the rotor 4 is rotatable about a longitudinal axis L.

The operation of the above described closure and/or regulation element is, for example, as follows.

If by rotating the rotor 4 the through-passages or openings 8, 9 brought more or less into alignment, then under the effect of the ferrostatic pressure of the melt 2 in the metallurgical vessel i melt flows through the openings 8, 9 and the outflow channel 10 into the chill mold 11. The ferrostatic pressure is a function of the particular height of the melt level in the vessel 1. In order to maintain or set the outflow rate of the melt 2 constant, the vacuum generator 17 generates an underpressure in the underpressure chamber 14. Such vacuum acts on the one hand in the sealing gap 7 and on the other hand in the outflow channel 10. Such vacuum counteracts the ferrostatic pressure of the melt 2 in the vessel 1, and in addition acts in such a way that melt penetrating into the sealing gap 7 cannot exit toward the outside. By controlling the underpressure an essentially constant height of the level of the melt in the chill mold 11 can be attained. It is also possible to achieve uniform filling of the chill mold 11. By control of the underpressure, vortices of the melt flowing through the outflow channel 10 also can be avoided.

Figure 2:
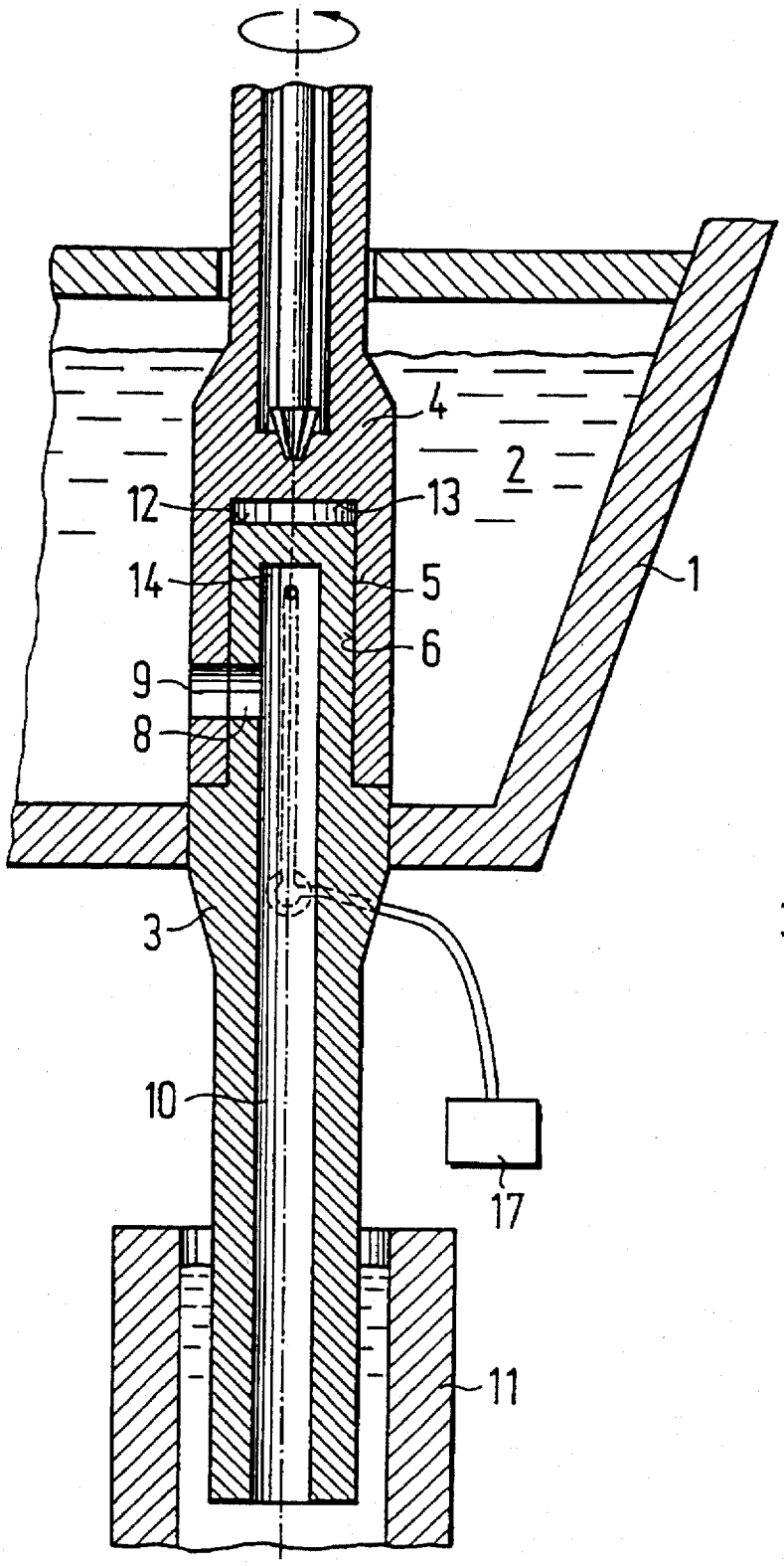
FIG. 2 is a cross section of a closure and/or regulation element wherein a rotor extends from above a stator.
Figure 3:
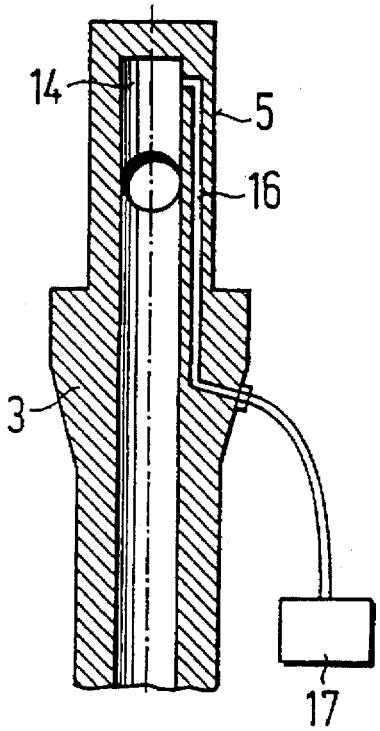
FIG. 3 is a cross section of the rotor according to FIG. 2.

In contrast to FIG. 1, in the embodiment according to FIGS. 2 and 3 the rotor 4 projects from above into the vessel 1. Rotor 4 fits over or overlaps on the outside the stator 3 projecting from below into the vessel 1. The outflow channel 10 is formed in the stator 3. The interspace between the faces 12 and 13 does not serve as an underpressure chamber. Rather, underpressure chamber 14 is disposed in the stator 3 above the through-passages or openings 8, 9 and is an upper extension of the outflow channel 10. The channel or conduit 16 is formed in the stator 3 and has an upper end terminating in the underpressure chamber 14 and extends downwardly therefrom to the outside within the cylindrical sealing face 5 and is connected to vacuum generator 17.

The operation of this embodiment corresponds to that of the embodiment according to FIG. 1 with the exception that the underpressure in the underpressure chamber 14 of FIG. 2 does not act on the sealing gap 7. If the underpressure is also to act on the sealing gap 7, a bore corresponding to bore 15 of FIG. 1 is provided in the face 12 of the stator 3.

Figure 4:
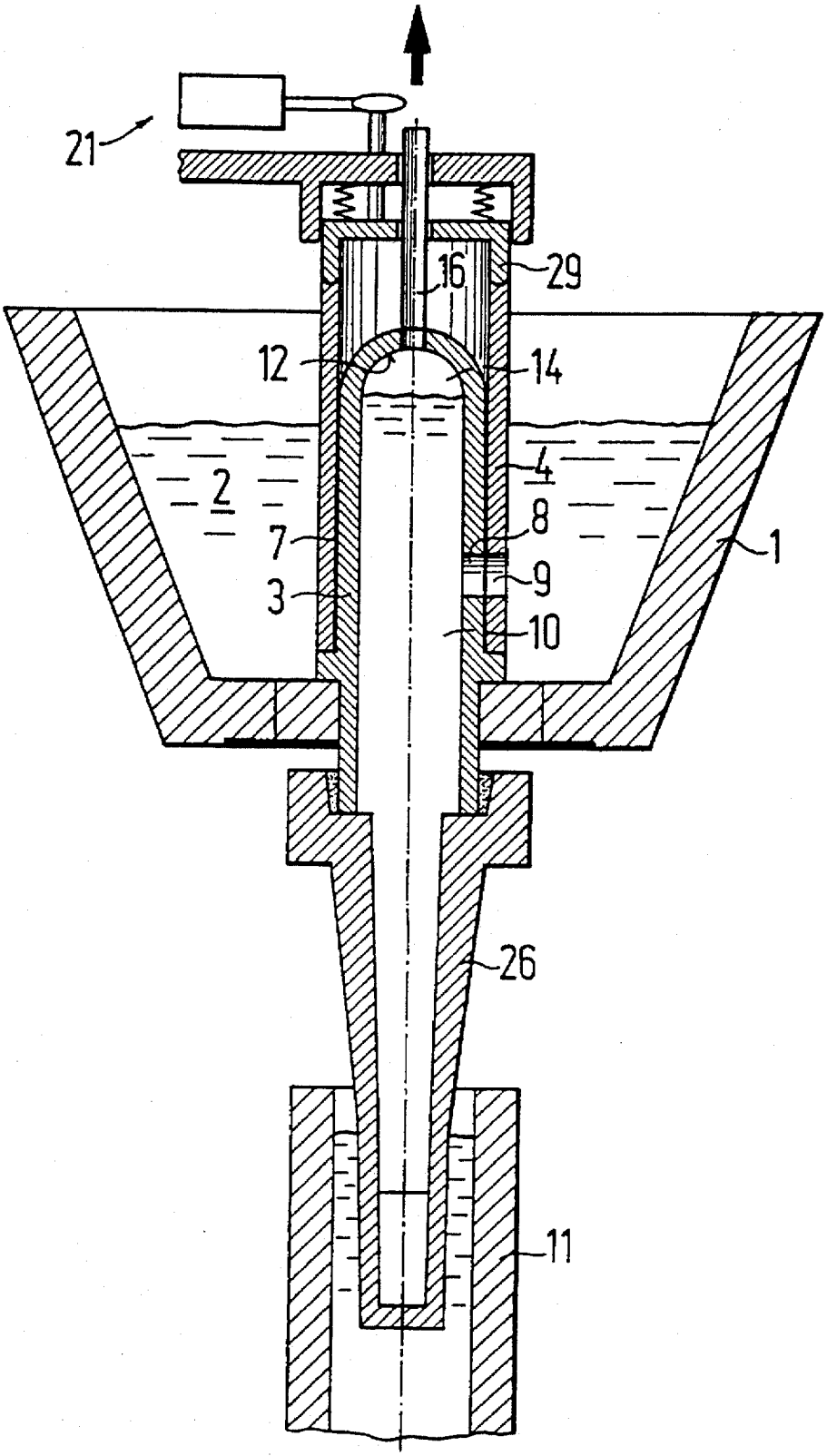
FIG. 4 is a cross section of a further embodiment of a closure and/or regulation element wherein a rotor extends from above a stator.

In the embodiment according to FIG. 4 the stator 3 is fastened into the vessel 1. Outflow channel 10 extends into an extension piece 26 which projects into the chill mold 11. The stator 3 extends above the melt level in the vessel 1. The rotor 4 is positioned on the stator 3 and is formed by a tube-shaped member having on the top thereof a head piece 29 that is engaged by a drive unit 21 by which the rotor can be rotated. Channel or conduit 16 terminates in underpressure chamber 14 disposed in the upper region of the stator 3. Channel or conduit 16 extends through the rotor 4 and its head piece 29 upwardly to vacuum generator 17. In comparison to FIG. 2, in FIG. 4 the surface which is acted upon by the underpressure in the stator 3 is greater.

Figure 5:
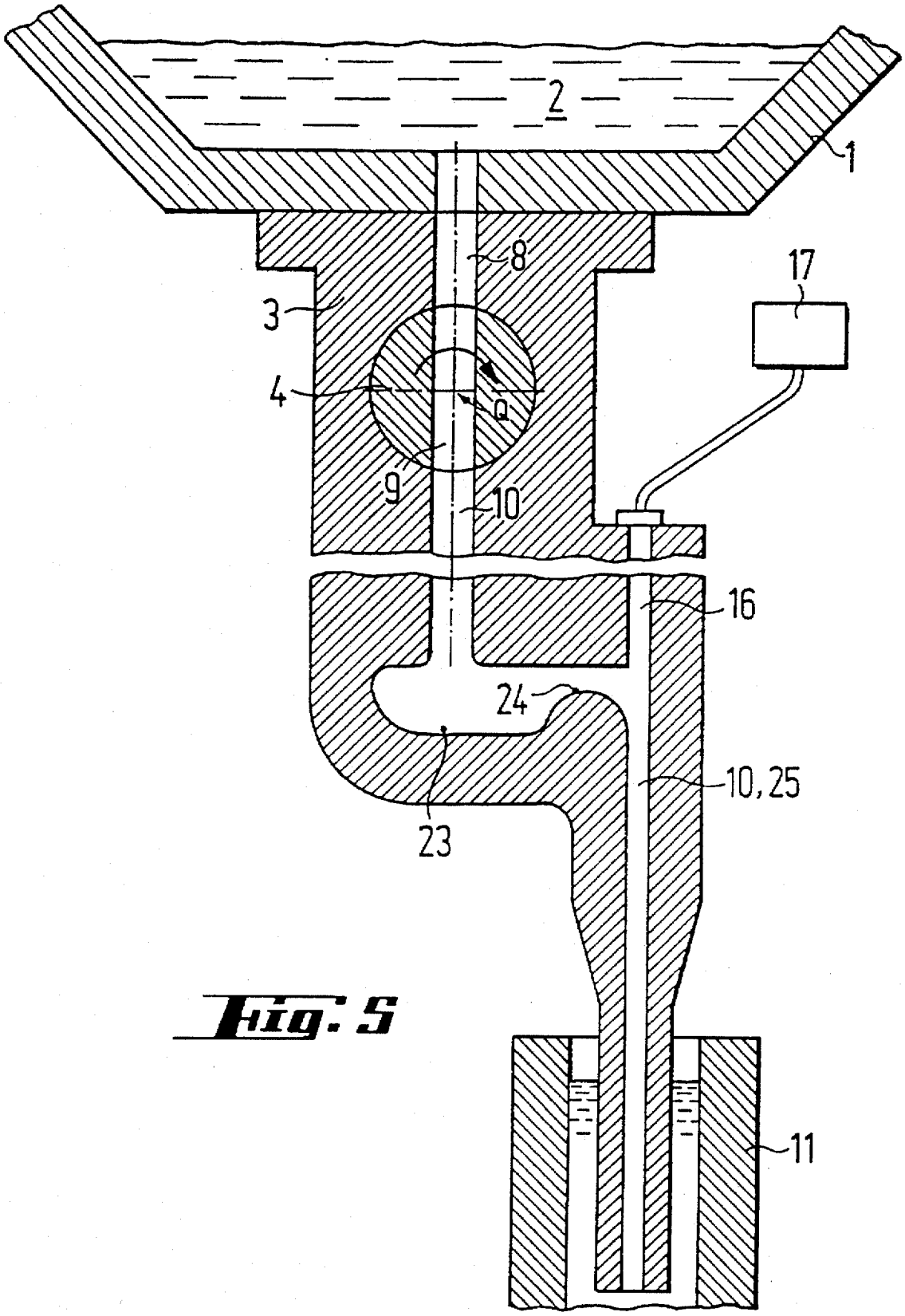
FIG. 5 is a cross section of a closure and/or regulation element with a sump-forming chamber.

In the embodiment according to FIG. 5 the stator 3 is disposed below the vessel 1. The rotor 4 is rotatably supported in the stator 3. The rotor 4 is not rotatable about the longitudinal axis L but rather is rotatable about transverse axis Q. The rotor 4 is a cylindrical body through which the through-passage or opening 9 extends radially. Outflow channel 10 is in stator 3 below the rotor 4. Below the rotor 4 channel 10 has a sump chamber 23 which at an overflow edge 24 changes over into a portion 25 leading into the chill mold 11. The portion 25 of the outflow channel 10 is slit-shaped in cross section for casting a thin slab. Channel or conduit 16 extends in the direction of flow of the melt into portion 25 at a location after overflow edge 24 and 25 is connected with vacuum generator 17. Channel or conduit 16 also can extend from directly above the overflow edge 24 or from above the sump chamber 23. It is also possible to provide between the mouth and the channel or conduit 16 an underpressure chamber expanding channel or conduit 16 toward the mouth.

The operation of this embodiment essentially is identical to that described above. By controlling the underpressure in the channel or conduit 16, the flow rate of the melt leaving the outflow channel 10 can be controlled.

Figure 6:
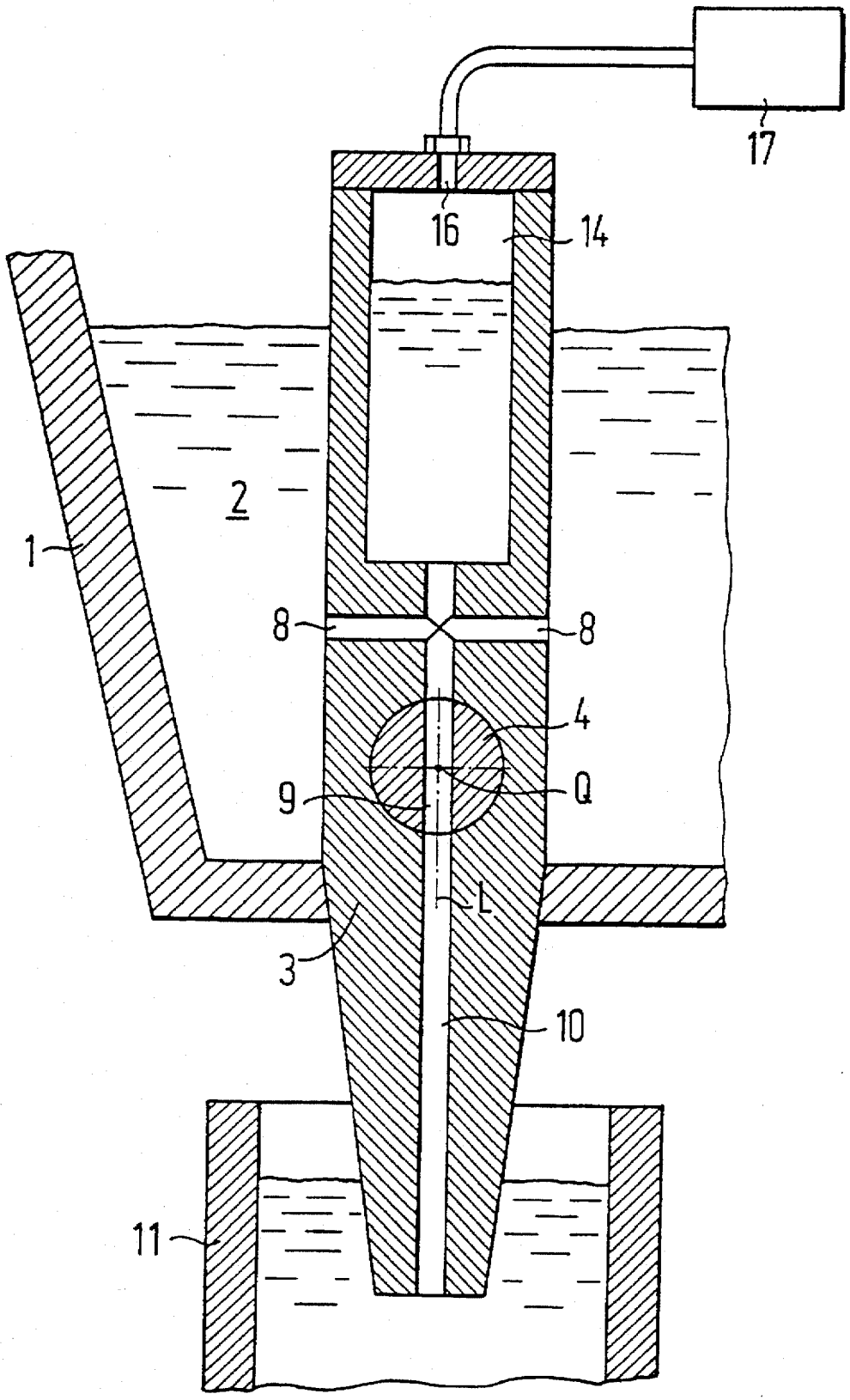
FIG. 6 is a cross section of a closure and/or regulation element wherein a rotor is supported in a stator rotatably about a transverse axis.

In the embodiment according to FIG. 6 rotor 3 and stator 4 are for example constructed as described in DE 38 05 071 C2. The rotor 4 is rotatable in the stator 3 about a transverse axis Q. The underpressure chamber 14 is located in the stator 3 above through-passages or openings 8. The underpressure chamber 14 terminates at the through-passages or openings 8. The stator 3 and the underpressure chamber 14 extend to above the level of the melt 2 in vessel 1. The cross-sectional area of the underpressure chamber 14 is greater than the cross section of the outflow channel 10 in the proximity of the rotor 4.

The operation of the embodiment according to FIG. 6 is essentially identical to the described operation. By controlling the underpressure in the underpressure chamber 14, it is possible to control the speed at which the melt enters through the through-passages or openings 8 into the through-passage or opening 9 of the rotor 4.

Figure 7:
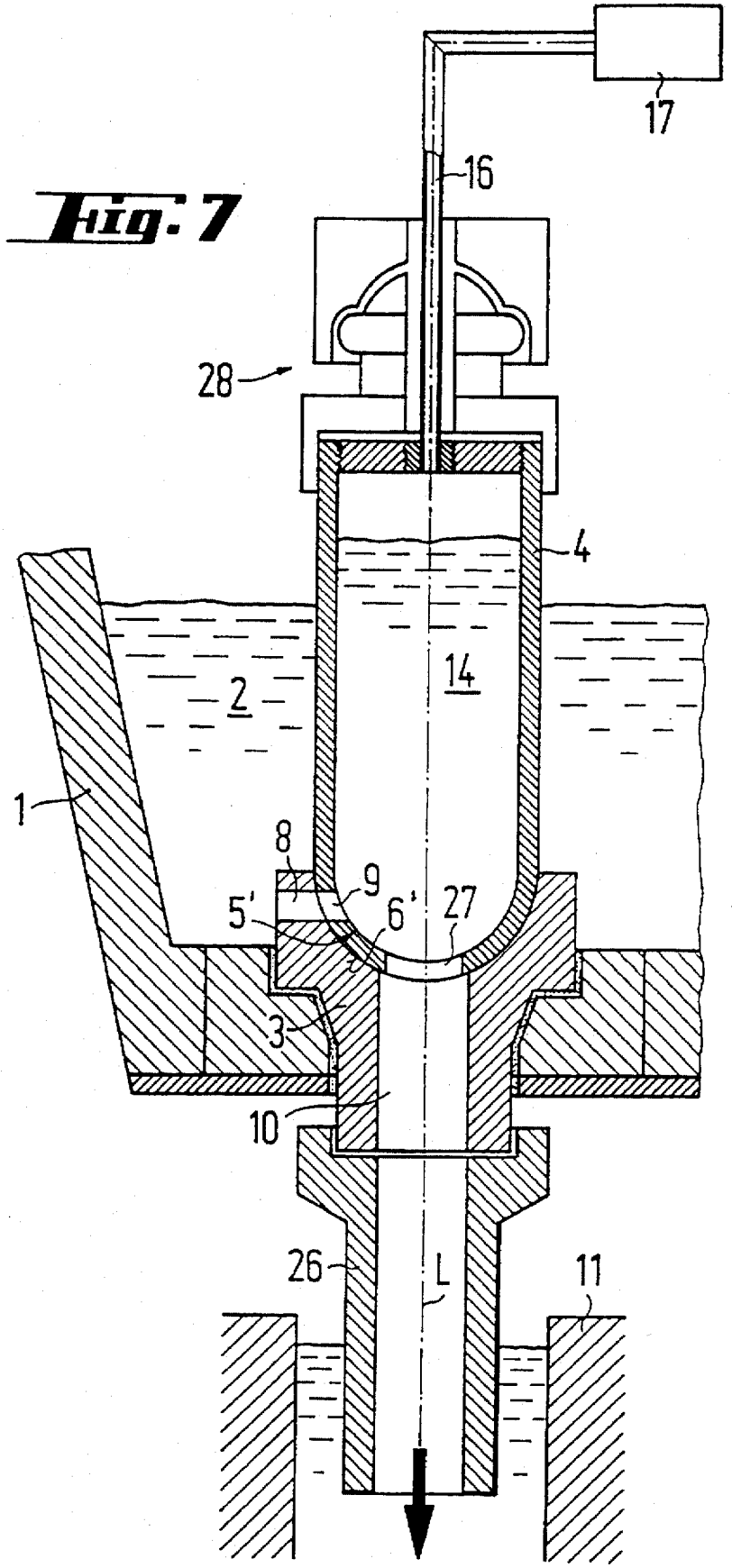
FIG. 7 is a cross section of a closure and/or regulation element wherein a rotor extends from above and into a stator.

In the embodiment according to FIG. 7 the rotor 4 projects into the vessel 1 from above. The stator 3 is secured or fastened on the bottom of vessel 1. The rotor 4 and the stator 3 are in contact, in this embodiment, along semi-spherical sealing surfaces 5', 6'. In the region of the sealing surfaces 5', 6' are disposed the through-passages or openings 8, 9. The outflow channel 10 is formed in the stator 3 and continues in an extension piece 26 into the chill mold 11. In the region of the outflow channel 10 the rotor 4 is provided with an outflow opening 27 disposed centrally with respect to the longitudinal axis L. The horizontal cross section of underpressure chamber 14 within the interior of rotor 4 tapers from the through-passage or opening 9 to the outflow opening 27. The underpressure chamber 14 extends above the level of the melt 2 in vessel 1. This augments the effect of the underpressure on the melt flowing from the through-passages or openings 8, 9 to the outflow opening 27 and, consequently, into the outflow channel 10. In the embodiments according to FIGS. 1 to 3, it is also possible to design the underpressure chamber 14 so that its upper boundary is above the level of the melt 2 in the vessel 1. The rotor 4, at the top thereof, is supported oscillatingly such that its spherical sealing surface 6' is in close contact on the sealing surface 5' of the stator 3 in each rotational position. The weight and a pressure acting upon a bearing device 28 improve the closeness of contact of the sealing surfaces 5', 6'. By means of the bearing device 28 the rotor 4 is rotatable about the longitudinal axis L. Channel or conduit 16 terminating at the top in the rotor 4 leads to vacuum generator 17.

We claim:

1. An apparatus for controlling the discharge of a melt from a metallurgical vessel, said apparatus comprising:

a stator and a rotor that is rotatable relative to said stator, said stator and said rotor having cooperating sealing surfaces, and said stator and said rotor having therethrough, in the region of said sealing surfaces, respective through passages that lead to an outflow channel and that can be brought into and out of alignment by rotation of said rotor relative to said stator;

an underpressure chamber defined by at least one of said stator and said rotor, said underpressure chamber being located above said through passages and being connected to said outflow channel; and a conduit connected to said underpressure chamber and extending through at least one of said stator and said rotor to connect said underpressure chamber with a source of vacuum.

2. An apparatus as claimed in claim 1, wherein said underpressure chamber comprises an extension of said outflow channel above said through passages.

3. An apparatus as claimed in claim 1, wherein said rotor is rotatably mounted within said stator, said outflow channel is defined within said rotor, said underpressure chamber is defined between opposed end faces of said stator and said rotor, and said underpressure chamber is connected to said outflow channel by at least one bore extending through said end fact of said rotor.

4. An apparatus as claimed in claim 1, wherein said underpressure chamber is connected with a sealing gap defined between said sealing surfaces of said stator and said rotor.

5. An apparatus as claimed in claim 1, wherein said rotor is rotatably mounted about said stator, said outflow channel is defined within said stator, and said underpressure chamber comprises an extension of said outflow channel closed by an end face of said stator.

6. An apparatus as claimed in claim 5, wherein said conduit extends through said stator.

7. An apparatus as claimed in claim 5, wherein said conduit extends upwardly through said rotor.

8. An apparatus as claimed in claim 1, wherein said underpressure chamber is connected to said through passage of said stator.

9. An apparatus as claimed in claim 1, wherein said sealing surfaces are cylindrical.

10. An apparatus as claimed in claim 1, wherein said sealing surfaces are partially spherical.

11. An apparatus as claimed in claim 10, wherein said underpressure chamber is within said rotor and is connected to said through passages.

12. An apparatus as claimed in claim 11, wherein said underpressure chamber has a size that reduces below said through passages toward said outflow channel.

13. An apparatus as claimed in claim 1, wherein said underpressure chamber has a cross section larger than a cross section of said outflow channel.

14. An apparatus as claimed in claim 1, wherein said stator and said rotor are dimensioned such that, when said apparatus is mounted in a metallurgical vessel, a portion of said underpressure chamber will be above the level of melt in the vessel.

15. An apparatus for controlling the discharge of a melt from a metallurgical vessel, said apparatus comprising:

a stator and a rotor that is rotatable relative to said stator, said stator and said rotor having cooperating sealing surfaces, and said stator and said rotor having therethrough, in the region of said sealing surfaces, respective through passages that lead to an outflow channel and that can be brought into and out of alignment by rotation of said rotor relative to said stator;

said outflow channel including a sump chamber leading to a downstream portion, relative to a direction of flow of melt through said outflow channel; and a conduit connected to said outflow channel adjacent one of said sump chamber and said downstream portion to connect said outflow channel to a source of vacuum.

16. An apparatus as claimed in claim 15, wherein said outflow channel and said conduit extend through said stator.

17. An apparatus as claimed in claim 15, further comprising an overflow edge between said sump chamber and said downstream portion.

18. An apparatus as claimed in claim 17, wherein said conduit is connected to said downstream portion immediately downstream of said overflow edge.

19. An apparatus as claimed in claim 17, wherein said conduit is connected to said outflow channel at a position above said overflow edge.

* * * * *